US008215839B2

(12) United States Patent
Borchardt et al.

(10) Patent No.: US 8,215,839 B2
(45) Date of Patent: Jul. 10, 2012

(54) MULTISTEP OCCLUDING ZIPPER WITH SEALING FEATURES

(75) Inventors: Michael G. Borchardt, Naperville, IL (US); Andrew E. Neltner, Loveland, OH (US)

(73) Assignee: The Glad Products Company, Oakland, CA (US)

( * ) Notice: Subject to any disclaimer, the term of this patent is extended or adjusted under 35 U.S.C. 154(b) by 463 days.

(21) Appl. No.: 12/476,845

(22) Filed: Jun. 2, 2009

(65) Prior Publication Data

US 2010/0299881 A1 Dec. 2, 2010

(51) Int. Cl.
*B65D 33/16* (2006.01)
*A44B 19/02* (2006.01)

(52) U.S. Cl. ..... 383/63; 383/59; 383/61.2; 383/203; 24/585; 24/DIG. 50

(58) Field of Classification Search ..... 383/203, 383/61.2, 63, 59; 28/399, 400, 585.12, DIG. 50
See application file for complete search history.

(56) References Cited

U.S. PATENT DOCUMENTS 4,186,786 A 2/1980 Kirkpatrick
4,285,105 A 8/1981 Kirkpatrick
4,829,641 A * 5/1989 Williams ..... 24/585.12
4,907,321 A * 3/1990 Williams ..... 24/585.12
5,070,584 A 12/1991 Dais et al.
5,235,731 A * 8/1993 Anzai et al. ..... 24/590.1
5,368,394 A 11/1994 Scott et al.
5,462,360 A * 10/1995 Tilman et al. ..... 383/63
5,558,439 A * 9/1996 Tilman ..... 383/63
5,558,613 A * 9/1996 Tilman et al. ..... 493/214
5,573,614 A * 11/1996 Tilman et al. ..... 156/66
5,577,305 A 11/1996 Johnson
5,647,100 A 7/1997 Porchia et al.
5,774,955 A 7/1998 Borchardt et al.
6,047,450 A * 4/2000 Machacek et al. ..... 24/399
6,167,597 B1 1/2001 Malin
6,220,754 B1 * 4/2001 Stiglic et al. ..... 383/64
6,299,353 B1 * 10/2001 Piechocki et al. ..... 383/63
6,533,456 B1 * 3/2003 Buchman ..... 383/63
6,539,594 B1 * 4/2003 Kasai et al. ..... 24/585.12
6,568,046 B1 * 5/2003 Savicki et al. ..... 24/387
6,595,689 B1 * 7/2003 Borchardt et al. ..... 383/64
6,612,002 B1 * 9/2003 Savicki ..... 24/585.1
6,651,297 B1 * 11/2003 Borchardt ..... 24/399
6,691,375 B1 * 2/2004 Savicki ..... 24/30.5 R
6,733,178 B2 * 5/2004 Bois ..... 383/59
6,755,569 B2 * 6/2004 Bois ..... 383/59
7,017,240 B2 * 3/2006 Savicki ..... 24/387
7,040,808 B2 * 5/2006 Rehwinkel et al. ..... 383/61.2
7,137,736 B2 11/2006 Pawloski et al.
7,162,779 B2 * 1/2007 MacHacek ..... 24/399
7,192,192 B2 * 3/2007 VandenHeuvel et al. ..... 383/65
7,260,871 B2 * 8/2007 Borchardt et al. ..... 24/399
7,322,747 B2 * 1/2008 Borchardt ..... 383/63
7,346,964 B2 * 3/2008 Siegel ..... 24/399
7,437,805 B2 * 10/2008 Berich ..... 24/399
7,543,361 B2 * 6/2009 Borchardt et al. ..... 24/399
7,857,515 B2 * 12/2010 Dais et al. ..... 383/59
7,886,412 B2 * 2/2011 Dais et al. ..... 24/585.12
7,946,766 B2 * 5/2011 Dais et al. ..... 383/59

(Continued)

*Primary Examiner* — Rinaldi I Rada
*Assistant Examiner* — Gloria R Weeks
(74) *Attorney, Agent, or Firm* — David Peterson

(57) ABSTRACT

A closure device for a thermoplastic bag which includes two opposing, longitudinally extending interlockable male and female fastening strips having respective male and female closure elements or profiles with outside wings that are deformed when the closure device is fully occluded.

18 Claims, 6 Drawing Sheets

U.S. PATENT DOCUMENTS

| | | | | |
|---|---|---|---|---|
| 8,087,826 | B1 * | 1/2012 | Blythe et al. | 383/64 |
| 2002/0034344 | A1 * | 3/2002 | Bois | 383/61 |
| 2003/0095727 | A1 * | 5/2003 | Leighton | 383/63 |
| 2004/0001651 | A1 * | 1/2004 | Pawloski | 383/63 |
| 2004/0261229 | A1 | 12/2004 | Cisek | |
| 2006/0008184 | A1 | 1/2006 | Borchardt et al. | |
| 2006/0171609 | A1 * | 8/2006 | Turvey et al. | 383/63 |
| 2008/0019619 | A9 * | 1/2008 | Eads et al. | 383/61.2 |
| 2008/0226203 | A1 | 9/2008 | Dais et al. | |
| 2008/0226204 | A1 * | 9/2008 | Sabounjian et al. | 383/74 |
| 2008/0247679 | A1 * | 10/2008 | Dayton et al. | 383/33 |
| 2009/0214141 | A1 * | 8/2009 | Borchardt et al. | 383/63 |
| 2010/0014786 | A1 * | 1/2010 | Pawloski et al. | 383/59 |
| 2010/0177989 | A1 * | 7/2010 | Coonce et al. | 383/63 |

* cited by examiner

MULTISTEP OCCLUDING ZIPPER WITH SEALING FEATURES

BACKGROUND OF THE INVENTION

1. Field of the Invention

The present invention relates generally to interlocking closure devices for thermoplastic storage bags, and more particularly, to an interlocking closure device which proceeds in more than one step when the closure device is being closed.

2. Description of the Related Art

The use of closure devices for fastening storage containers, including plastic bags, is generally known. Furthermore, the manufacture of closure devices made of plastic materials is generally known to those skilled the in the art, as demonstrated by the numerous patents in this area.

A particularly well-known use for closure devices is in connection with flexible storage containers, such as plastic bags. In some instances, the closure device and the associated container are formed from thermoplastic materials, and the closure device and the sidewalls of the container are integrally formed by extrusion as a single piece. Alternatively, the closure device and sidewall of the container may be formed as separate pieces and then connected by heat sealing or any other suitable connecting process. In either event, such closure devices are particularly useful in providing closure means for retaining matter within the bag.

Conventional closure devices typically utilize a thermoplastic zipper in the form of mating fastening strips or closure elements, which are used to selectively seal the bag. The fastening strips comprise interlockable male and female profiles. With such closure devices, however, it is often difficult to determine whether the fastening strips are fully occluded. The problem addressed by the present invention pertains to the determination of closure or nonclosure of the zipper of a reclosable thermoplastic bag.

One technique for aiding in the determination of the state of zipper is to utilize a zipper that imparts a visual color change upon closure. Different colors may be utilized in each of the opposing zipper profiles to produce a third distinct color when interlocked. Zippers utilizing such a color change are seen in U.S. Pat. Nos. 4,186,786 and 4,285,105.

It is well understood that all thermoplastic zippers have an occlusion and peel force. For example, U.S. Pat. No. 5,368,394 to Scott et al. discloses a reclosable bag with closure profiles having stabilizer wedges. Using these stabilizer wedges, the force required to open the bag may be preselected by appropriately choosing the angles at which the surfaces of stabilizer wedges contact one another. It is also known that a desired tactile effect can be achieved during opening or closure of the zipper by changing the occlusion and peel force along the length of the zipper. In another example found in U.S. Pat. No. 7,137,736 to Pawloski et al., the reclosable pouch with a first closure mechanism having a first closure characteristic and a second closure mechanism having a second closure characteristic.

One technique for changing this force is to remove portions of one or both of the male and female zipper profiles such that there is a discontinuity in structure in those portions of the opposing profiles which contact each other upon interlockment of the zipper. Examples of zippers having closure profiles with portions removed are disclosed in U.S. Pat. No. 5,070,584 to Dais et al. and U.S. Pat. No. 5,647,100 to Porchia et al.

However, there still exists a need for alternative and improved thermoplastic closure members that impart a closure perceptible to the touch so that the fact of closure can be confirmed by a nonvisual means, i.e., by feel.

Accordingly, it is desired to provide a reclosable bag having an improved closure member that imparts a multistep process perceptible to the touch; and it is desired to provide a method for production of the reclosable bag wherein material is not removed from the closure region such that leak resistance through the closure is improved.

SUMMARY OF THE INVENTION

The present invention provides a closure device for a thermoplastic bag which includes two opposing, longitudinally extending interlockable male and female fastening strips having respective male and female closure elements or profiles that are deformed to interdigitate and produce a tactile effect that is perceptible to the touch as the closure device is opened and closed. Interdigitation of the two profiles is achieved by cold forming the profiles while interlocked. The shape of the cold form is a stepped deflection of both profiles so that their shapes are generally congruent. The stepped deflections provide a change in the occlusion and peel force of the interlocking closure device thereby resulting in a tactile change in feel as the closure device is closed.

In accordance with an advantageous aspect of the invention, the compressive force across the profile of the closure is graduated such that the greatest amount of compression is experienced at the interlocking members adjacent to the height extended wings at the innermost side of the closure device located nearest to the closed bottom end portion of the bag. In this way, leak resistance through the closure device is improved and the desired tactile effects are still achieved.

In accordance with one embodiment of the invention, the invention includes a closure device for a reclosable plastic bag comprising first and second interlocking fastening strips arranged to be interlocked over a predetermined length, wherein the first fastening strip including a first interlocking member and a third interlocking member and further including a first flexible wing adjacent the first interlocking member and extending from the first fastening strip beyond the height of the first interlocking member; the second fastening strip including a second interlocking member for mating with the first interlocking member and a fourth interlocking member for mating with the third interlocking member, the second fastening strip further including a second flexible wing adjacent the second interlocking member and extending from the second fastening strip beyond the height of the second interlocking member; whereby the first wing engages with the second wing when the first and second fastening strips interlock.

In accordance with another embodiment of the invention, the invention includes a plastic bag including side walls joined at seams to form a compartment sealable by means of the closure device, wherein the side walls extend above the closure device to form mouth portions; wherein the closure device comprises first and second interlocking fastening strips arranged to be interlocked over a predetermined length, wherein the first fastening strip including a first interlocking member and a third interlocking member and further including a first flexible wing adjacent the first interlocking member and extending from the first fastening strip beyond the height of the first interlocking member; the second fastening strip including a second interlocking member for mating with the first interlocking member and a fourth interlocking member for mating with the third interlocking member, the second fastening strip further including a second flexible wing adjacent the second interlocking member and extending from the second fastening strip beyond the height of the second interlocking member; wherein the first and second wings are located on the outermost portions of the first and second fastening strips whereby the first wing engages with the second wing when the first and second fastening strips interlock.

In accordance with another embodiment of the invention, the invention includes a resealable closure mechanism having an elongate substantially constant profile extending between a first end and a second end, the profile comprising a first closure element having a first interlocking member, a third interlocking member, and a first wing member, each protruding from a first base member; and a second closure element having a second interlocking member, a fourth interlocking member and a second wing member, each protruding from a second base member; wherein the first interlocking member is resealably interlocked with the second interlocking member and the third interlocking member is resealably interlocked with the fourth interlocking member; wherein the first and second wings are engaged and resealably deformed when the closure mechanism is closed.

Methods and apparatus which incorporate the features described above and which are effective to function as described above constitute further, specific objects of the invention. Other objects and advantages of the invention will become apparent upon reading the following description and upon reference to the drawings.

BRIEF DESCRIPTION OF THE DRAWINGS

For a more complete understanding of this invention reference should now be had to the embodiments illustrated in greater detail in the accompanying drawings and described below by ways of examples of the invention. In the drawings.

DETAILED DESCRIPTION

Figure 1:
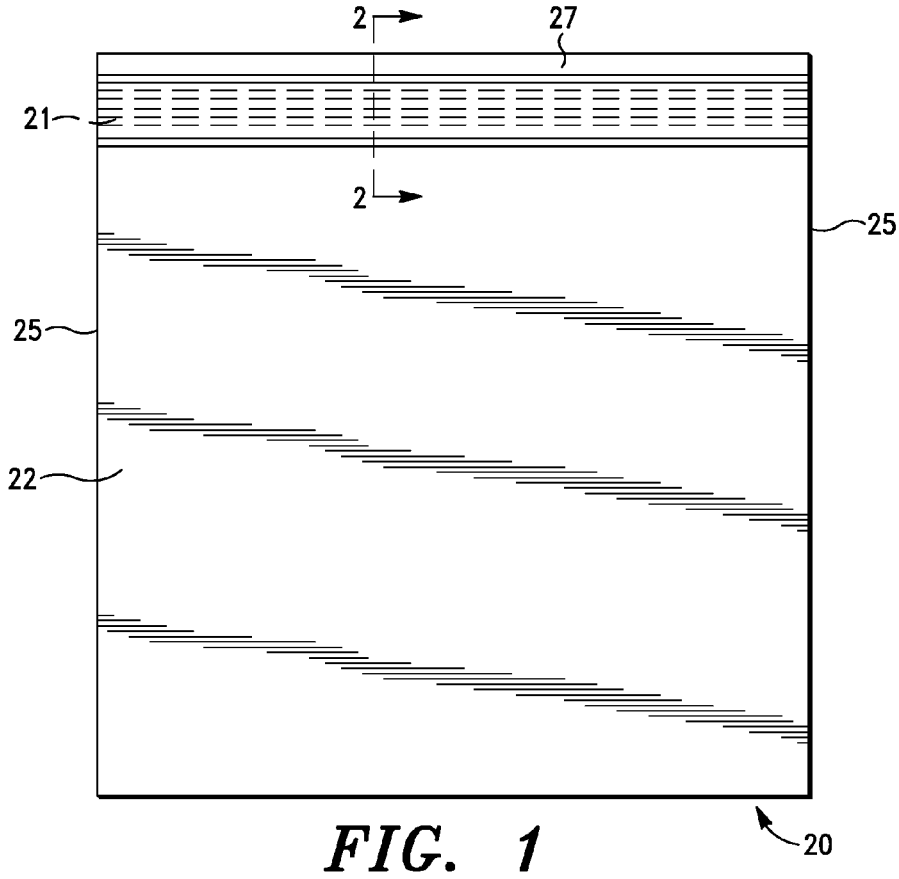
FIG. 1 is a perspective view of a container in the form of a thermoplastic bag having an interlocking closure device in accordance with the present invention.

The present invention provides interlocking closure devices with specially formed mating closure elements that produce a tactile sensation upon occlusion of the closure elements. As used herein and as generally understood in the art, the terms "male" and "female" closure elements refer to closure elements wherein the element that interlocks into the other closure element is referred to as the "male closure element" and the other element is referred to as the "female closure element." In addition, the terms "outermost" and/or "uppermost" webs refer to leg or stem portions of the male and female closure elements located nearest to the open top end of the bag. Conversely, the terms "innermost" and/or "lowermost" webs refer to leg or stem portions of the male and female closure elements located nearest to the closed bottom end portion of the bag.

The present invention provides interlocking closure devices in which a deformation is formed upon proper occlusion. A user thus is able to tactually perceive whether the closure device is properly occluded. In one embodiment, the closure device comprises interlocking male and female fastening strips arranged to be interlocked over a predetermined length. The male fastening strip includes a male closure element and a pair of male wings integrally attached to the male fastening strip and extending therefrom. The male wings are spaced-apart on the male fastening strip on each side of the male closure element and one of the male wings extends a greater distance from the base of the male fastening strip than the male closure element and the other male wing. The complementary female fastening strip includes a female closure element and a pair of female wings integrally attached to the female fastening strip and extending therefrom. The female wings are spaced-apart on the female fastening strip on each side of the female closure element to engage the male wings and one of the female wings extends a greater distance from the base of the female fastening strip than the female closure element and the other female wing. When the two fastening strips are pressed together, the fastening strips occlude in a multistep process. One of the wings on each fastening strip interact with each other to pivot the fastening strips at a pivot point and engage on one side of the fastening strips. Where each of the fasting strips contain multiple fastening elements, the fastening strips engage or occlude in a multistep process so that one set of fastening elements occludes with an initial pressure and a second set of fastening elements occludes with a second pressure.

As used herein and as generally understood in the art, the terms "male" and "female" closure elements refer to closure elements wherein the element that interlocks into the other closure element and having outwardly projecting hooks is referred to as the "male closure element" and the outer element is referred to as the "female closure element" and has inwardly projecting hooks.

In accordance with this embodiment of the present invention, the female wings engage the male wings such that a portion of the male fastening strip flexes when the male and female fastening strips interlock. This flexure creates a deformation in the male fastening strip and the deformation is locked into place by the interlocking male and female closure elements. The deformation provides tactile confirmation of occlusion of the closure device.

FIG. 1 illustrates a container according to the present invention in the form of a plastic bag 20 having a sealable closure device 21. The bag 20 includes side walls 22 joined at seams 25 to form a compartment sealable by means of the closure device 21. The side walls 22 may extend above the closure device 21 to form mouth portions 27. In other embodiments (not shown), the side walls do not extend above the closure device. Mouth portions 27 enable a user to grip the plastic bag 20 in a fashion to more conveniently be able to deocclude or open the closure device 21 to thereby open the bag 20.

Figure 2:
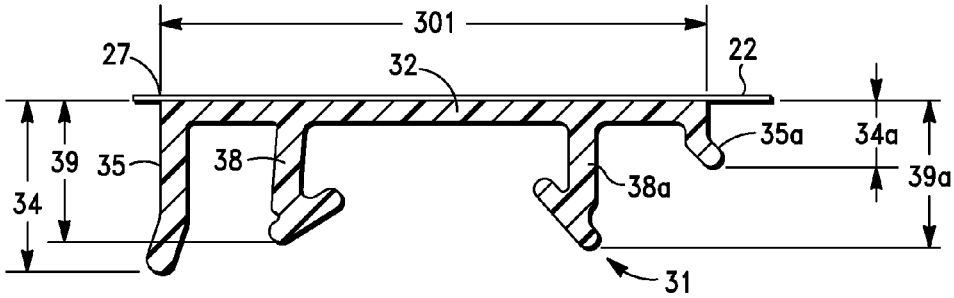
FIG. 2 is an enlarged partial cross-sectional view taken along line 2-2 in FIG. 1 illustrating the female fastening strip of a closure device of the present invention.
Figure 3:
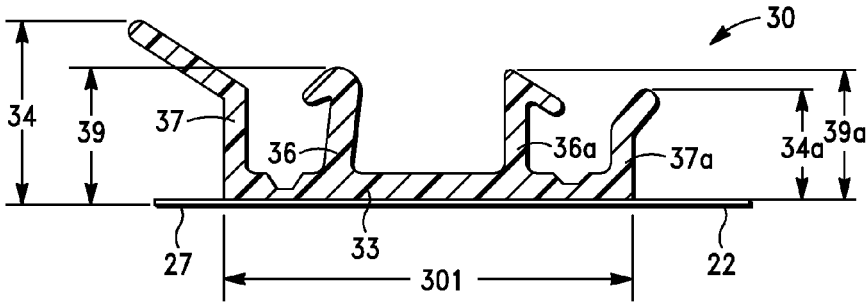
FIG. 3 is an enlarged partial cross-sectional view taken along line 2-2 in FIG. 1 illustrating the male fastening strip of a closure device of the present invention.

FIGS. 2 and 3 together illustrate a closure device according to one embodiment of the present invention. The closure device has an elongate substantially constant profile extending between a first end and a second end and comprises male and female interlocking fastening strips or closure elements 30, 31 arranged to be interlocked over a predetermined length of the bag 20. As shown in FIG. 2, the female fastening strip 31 comprises female interlocking members 38 and 38*a* protruding from a base member 32 and a pair of female wings 35 and 35*a* spaced apart on the female fastening strip 31 on each side of the female interlocking members 38 and 38*a*. Female wing 35 is on the innermost side of the closure device located nearest to the closed bottom end portion of the bag. Female wing 35*a* is on the outermost side of the closure device located nearest to the open top of the bag. As illustrated in FIG. 3, the male fastening strip 30 comprises a pair of male wings 37 and 37*a* protruding from a base member 33 and spaced-apart on the male fastening strip 30 on each side of the male interlocking members 36 and 36*a*. Male wing 37 is on the innermost side of the closure device located nearest to the closed bottom end portion of the bag. Male wing 37*a* is on the outermost side of the closure device located nearest to the open top of the bag. The female interlocking member 38 is resealably interlocked with male interlocking member 36 and female interlocking member 38*a* is resealably interlocked with male interlocking member 36*a*.

The male wing 37 shown in FIG. 3 is flexible and extends at a height 34 from the base 33 of the fastening strip 30 further than does a height 39 of the adjacent male interlocking member 36 (beyond the height of the male interlocking member 36). The male wing 37*a* extends at a height 34*a* less far from the base 33 of the fastening strip 30 than does a height 39*a* of the adjacent male interlocking 36*a* (below the height of the male interlocking member 36*a*). Although two wings are shown, a greater or lesser number of wings may be used, such as, one, three, four or more wings, for example there may be wings on only one side of the fastening strip. The female wing 35 shown in FIG. 2 is flexible and extends at a height 34 from the base 32 of the fastening strip 31 further than does a height 39 of the adjacent female interlocking member 38 (beyond the height of the female interlocking member 38). The female wing 35*a* extends at a height 34*a* less far from the base 32 of the fastening strip 31 than does a height 39*a* of the female interlocking member 38*a* (below the height of the female interlocking member 38*a*). The number of female wings may be equal to, greater than, or less than the number of male wings. The fastening strips 30, 31 has a length 301.

The fastening strips 30, 31 in FIGS. 2 and 3, may have the following parameters:

| Reference Number | Range inches (cm) | Example inches (cm) |
|---|---|---|
| 39, 39a | 0.024 (0.061) to 0.092 (0.234) | 0.040 (0.101) |
| 34 | 0.024 (0.061) to 0.115 (0.293) | 0.045 (0.114) |
| 34a | 0.024 (0.61) to 0.041 (0.104) | 0.034 (0.086) |
| 301 | 0.200 (0.508) to 0.342 (0.869) | 0.285 (0.724) |

Figure 4A:
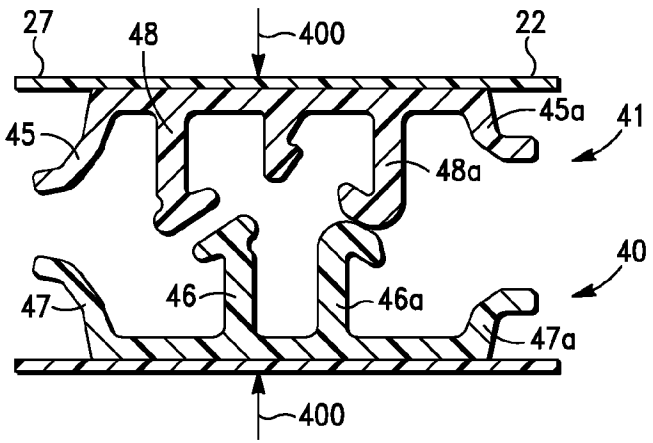
FIGS. 4A-4C are cross-sectional views of male and female fastening strips shown in various positions.
Figure 4B:
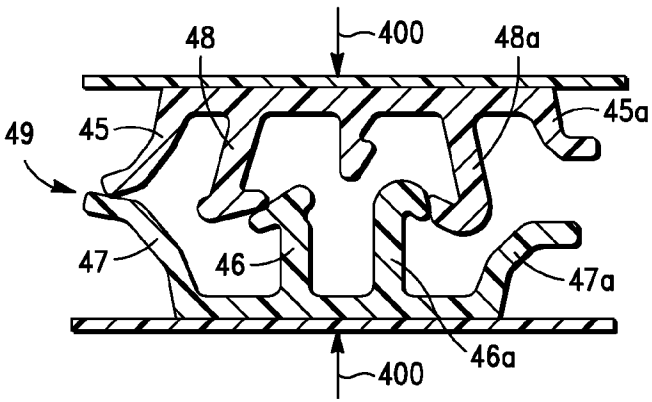
Figure 4C:
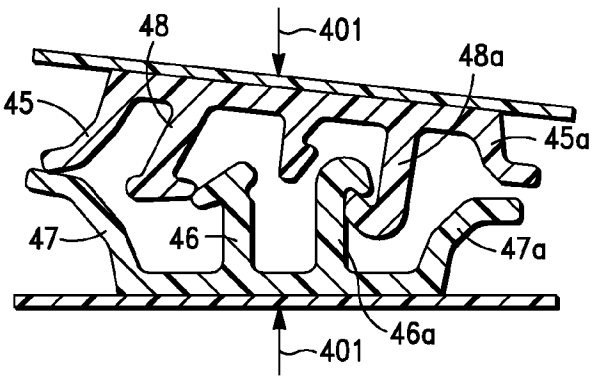

FIGS. 4A-4D illustrate occlusion of another embodiment of the closure device. In accordance with the invention, occlusion force 400 is applied to the opposed fastening strips 40, 41 in the direction denoted by the arrows shown in FIGS. 4A-4C. These forces are typically applied as the user depresses or pinches his or her fingers along a desired length of the fastening strips 40, 41. As the user begins to occlude the fastening strips, the longer male wing 47 engages the longer female wing 45 at the pivot point 49 as shown in FIG. 4B. As the user continues to apply the force 400, interference between the longer male wing 47 and the longer female wing 45 force the outside male interlocking member 46*a* to engage the outside female interlocking member 48*a* before the inside male interlocking member 46 engages the inside female interlocking member 48 as shown in FIG. 4C in the first step of the multistep occlusion process, requiring first occlusion force 401. At this point, the shorter male wing 47*a* and the shorter female wing 45*a* are not engaged. In this embodiment, the flexible longer male wing 47 is about the same height as the outside male interlocking member 46 and is longer than the shorter male wing 47*a*. The longer female wing 45 in this case is not longer than the inside female interlocking member 48, however, it still deforms the longer male wing 47 before the inside male interlocking member 46 engages the outside female interlocking member 48.

Figure 4D:
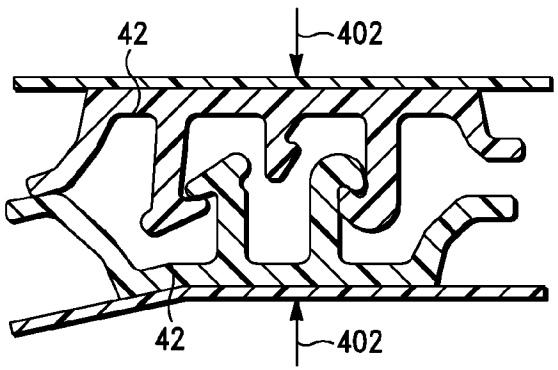
FIG. 4D is a cross-sectional view of the fastening strip of FIGS. 4A-4C in the occluded position.

In order to hold the fastening strips in a fully occluded position, the female interlocking members 48, 48*a* must engage the male interlocking members 46, 46*a*. As the user continues to apply the force 400, the fastening strips 40, 41 move to become fully engaged so that the female interlocking members 48, 48*a* and the male interlocking members 46, 46*a* pass each other as shown in FIG. 4D in the second step of the multistep occlusion process, requiring second occlusion force 402. At this point, the shorter male wing 47*a* and the shorter female wing 45*a* are not engaged. During this second step of the occlusion process, the male wing 47 and the female wing 45 exert greater force on one another resulting in greater force required to engage male interlocking member 46 and female interlocking member 48. In this fully occluded position of FIG. 4D, the inside section of the closure may be wider than the outside section of the closure. In order to facilitate the engagement of male interlocking member 46 and female interlocking member 48, the male fastening strip 40 may include notch 42 in the base or a notch in one of the wings (not shown). There may also be a notch 42 on the female fastening strip 41. Notches 42 may be provided in the base to facilitate deflection of the base.

The occlusion forces 401, 402, and the total occlusion force 400 may have a first range from about 200 grams to about 1500 grams, a second range from about 400 grams to about 1100 grams, and a third range from about 500 grams to about 1000 grams. The occlusion forces 401, 402, and 400 can be measured using the following test method.

Occlusion Force Test Method

Performed on an MTS RT/5 machine in order to evaluate the force required to occlude closure elements by point contact.

Cross head speed (compression): 1.0 inches per minute (2.54 cm per minute).

Occlusion Probe: Attached to crosshead. Contact area (uncompressed) 0.5 inches (1.27 cm)×0.5 inches (1.27 cm).

Probe composition: Natural or synthetic rubber with a hardness of Shore A 50-55.

Occlusion Plate: Substantially flat surface rigidly mounted to frame perpendicular to crosshead travel.

Break sensitivity: 90%.

Load Limit: 15 lbf (66.7 newtons).

Load cell: 250 newtons.

The operator positions aligned and unoccluded closure elements on occlusion plate centered under occlusion probe. The operator activates the test machine and the occlusion probe moves toward the occlusion plate and occludes the closure elements. The operator tests five points of occlusion along the length of a one gallon (3.8 liters) bag (approximate length 10.5 inches (26.7 cm)). The operator verifies peak load computed by program on testing machine.

The wings employed in this embodiment of the present invention have the additional advantage of serving as guide members. Guide members sometimes are incorporated into conventional closure devices to provide a further improved "feel" and further accuracy to such devices. Such guide members have been provided in the shape of triangles, rectangles or other suitable shapes and are generally provided by extrusion as integrally connected to one or both of the closure elements. In this embodiment of the present invention, the wings provide a funneling-type action as the fastening strips are brought together and the female closure element is brought into contact with the male closure element.

Figure 5A:
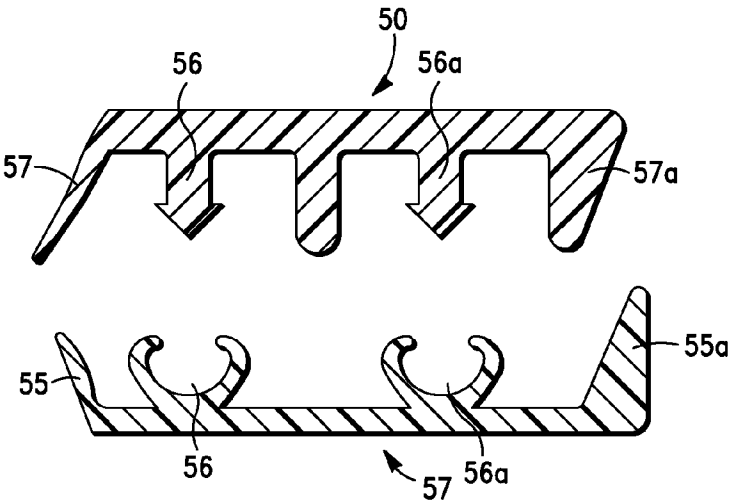
FIG. 5A-5C are cross-sectional views of male and female fastening strips shown in various positions.
Figure 5B:
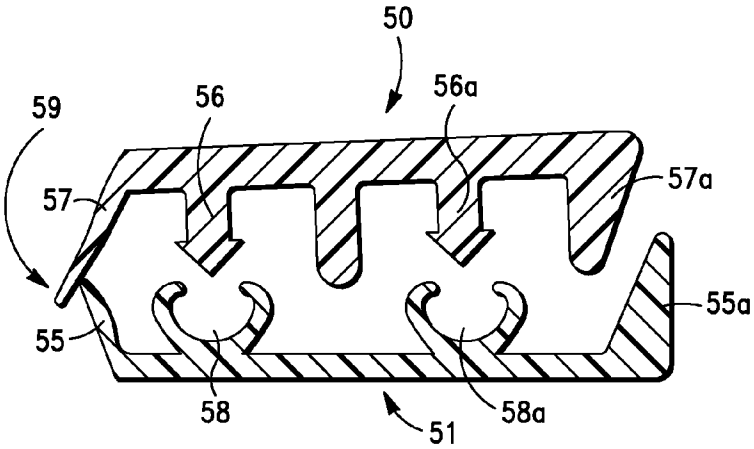
Figure 5C:
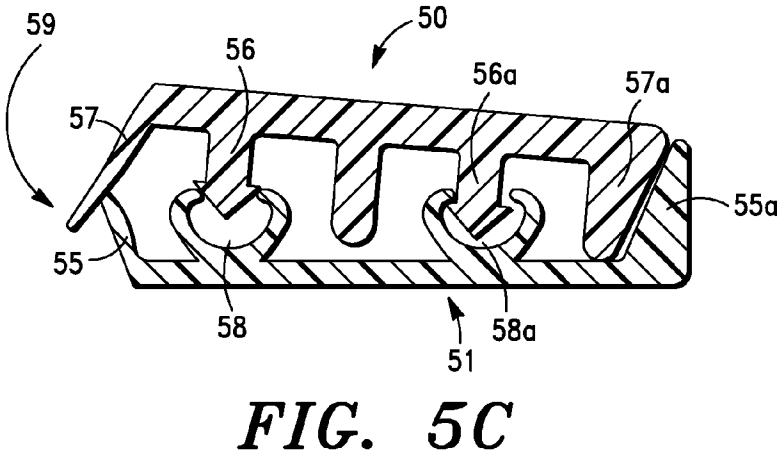
Figure 5D:
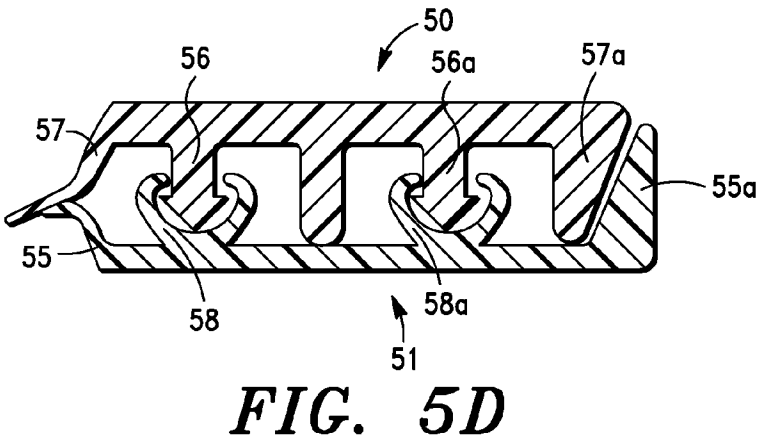
FIG. 5D is a cross-sectional view of the fastening strip of FIGS. 5A-5C in the occluded position.

FIGS. 5A-5D illustrate occlusion of another embodiment of the closure device. In accordance with the invention, male fastening strip 50 and female fastening strip 51 have rigid male guide wing 57*a* and rigid female guide wing 55*a* and flexible male wing 57 and flexible female wing 55. In this embodiment, both the rigid male guide wing 57*a* and rigid female guide wing 55*a* and flexible male wing 57 and flexible female wing 55 extend beyond the male interlocking members 56 and 56*a* and the female interlocking members 58 and 58*a* in the non-occluded position shown in FIG. 5A. FIG. 5B shows that as the two fastening strips are pressed together, the flexible male wing 57 and the flexible female wing 55 interact so that the fastening strips pivot at pivoting point 59. FIG. 5C shows that as the two fastening strips are pressed together, rigid male guide wing 57*a* and rigid female guide wing 55*a* align next to one another and the male interlocking member 56*a* and the female interlocking member 58*a* occlude in the first step of the multistep occlusion process. FIG. 5D shows the second step of the multistep occlusion process and the fully occluded closure where rigid male guide wing 57*a* and rigid female guide wing 55*a* align next to one another. The flexible male wing 57 and flexible female wing 55 interfere with one another and full occlusion of the closure requires greater force to engage the male interlocking member 56 and the female interlocking member 58 adjacent to the flexible wings 57 and 55 than to engage the male interlocking member 56*a* and the female hook interlocking member 58*a* adjacent to the rigid wings 57*a* and 55*a*.

Figure 6A:
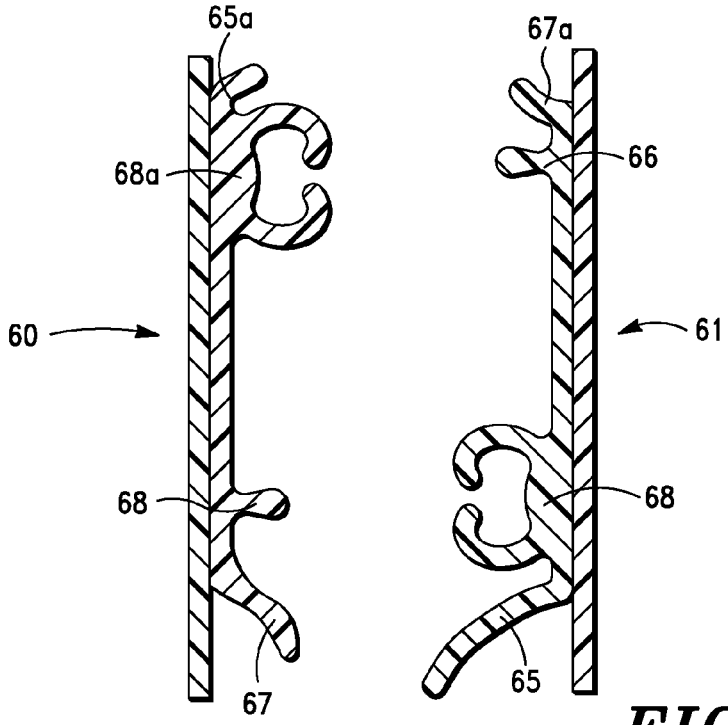
FIGS. 6A and 6B are cross-sectional views of male and female fastening strips shown in various positions.
Figure 6B:
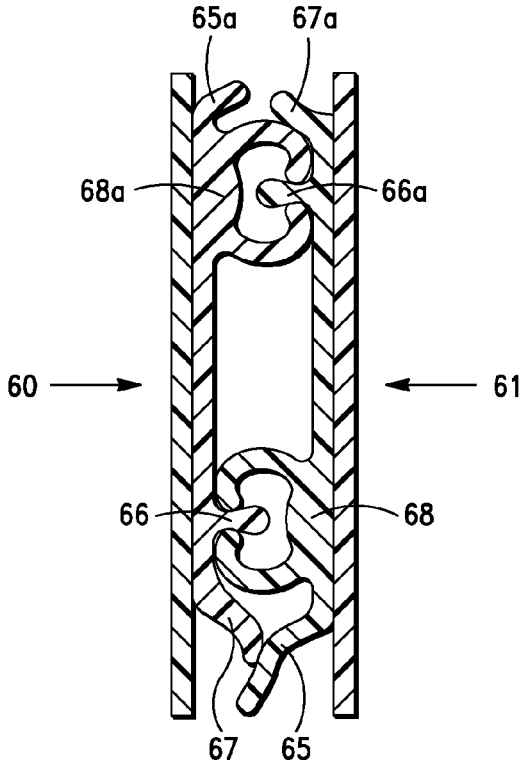

FIGS. 6A and 6B illustrate occlusion of another embodiment of the closure device. In accordance with the invention, the fastening strip 60 and the fastening strip 61 have both male interlocking members 66 and 66*a* and female interlocking members 68 and 68*a*. In this embodiment, one flexible male wing 67 and one flexible female wing 65 extend beyond the male interlocking member 66 and female interlocking member 68 in the non-occluded position shown in FIG. 6A. However, the rigid male guide wing 67*a* and rigid female guide wing 65*a* do not extend beyond the male interlocking member 66*a* and female interlocking members 68*a* in the non-occluded position shown in FIG. 6A. FIG. 6B shows the fully occluded closure where rigid male guide wing 67*a* and rigid female guide wing 65*a* do not touch one another. The flexible male wing 67 and flexible female wing 65 interfere with one another and full occlusion of the closure requires greater force to engage the male interlocking member 66 and the female interlocking member 68 adjacent to the flexible wings 67 and 65 than to engage the male interlocking member 66*a* and the female interlocking member 68*a* adjacent to the rigid wings 67*a* and 65*a*.

Figure 7A:
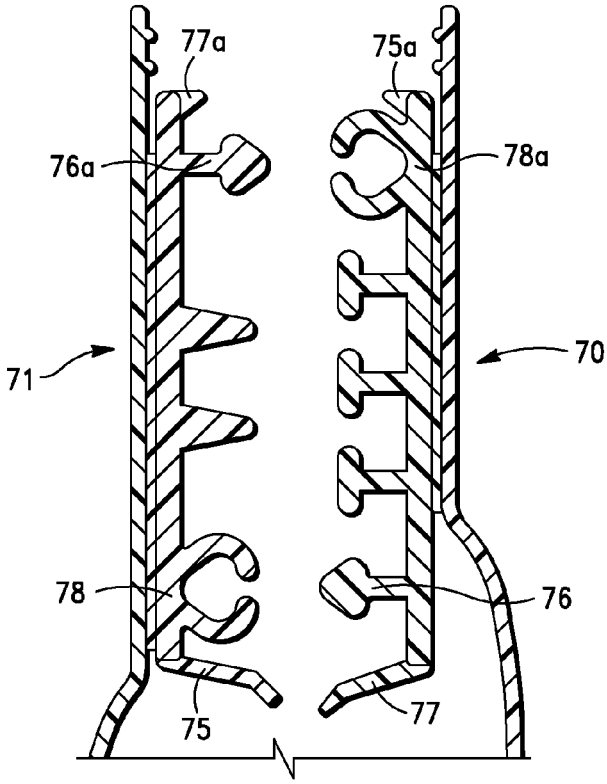
FIGS. 7A and 7B are cross-sectional views of male and female fastening strips shown in various positions.
Figure 7B:
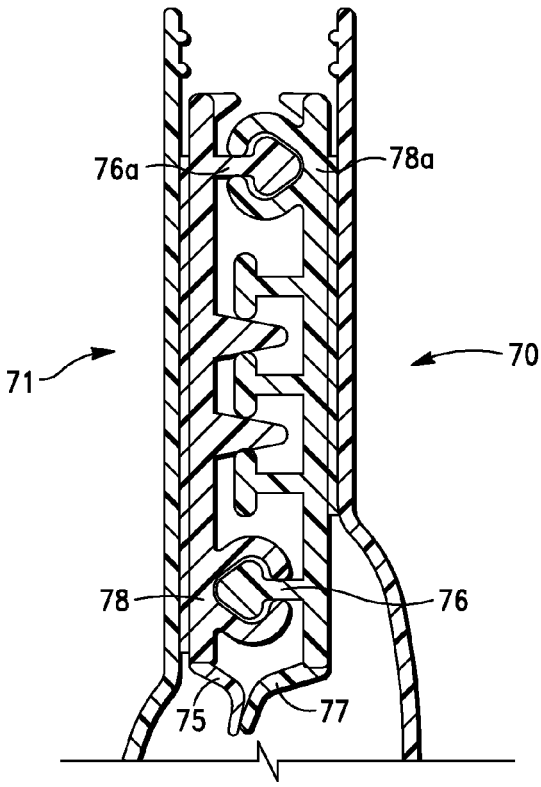

FIGS. 7A and 7B illustrate occlusion of another embodiment of the closure device. In accordance with the invention, the fastening strip 70 and the fastening strip 71 have both male interlocking members 76 and 76*a* and female interlocking members 78 and 78*a*. In this embodiment, one flexible male wing 77 and one flexible female wing 75 extend beyond the male interlocking member 76 and female interlocking member 78 in the non-occluded position shown in FIG. 7A. However, the rigid male guide wing 77*a* and rigid female guide wing 75*a* do not extend beyond the male interlocking member 76 and female interlocking member 78*a* in the non-occluded position shown in FIG. 7A. FIG. 7B shows the fully occluded closure where rigid male guide wing 77*a* and rigid female guide wing 75*a* do not touch one another. The flexible male wing 77 and flexible female wing 75 interfere with one another and full occlusion of the closure requires greater force to engage the male interlocking member 76 and the female interlocking member 78 adjacent to the flexible wings 77 and 75 than to engage the male interlocking member 76*a* and the female interlocking member 78*a* adjacent to the rigid wings 77*a* and 75*a*.

Figure 8A:
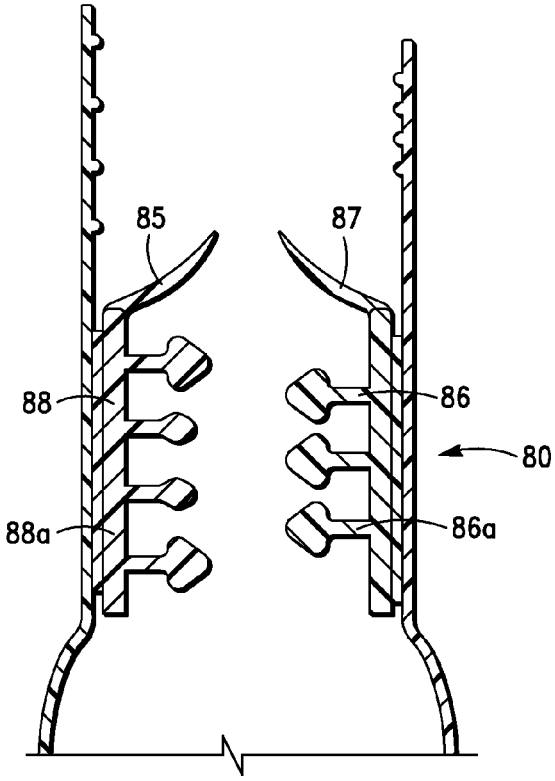
FIGS. 8A and 8B are cross-sectional views of male and female fastening strips shown in various positions.
Figure 8B:
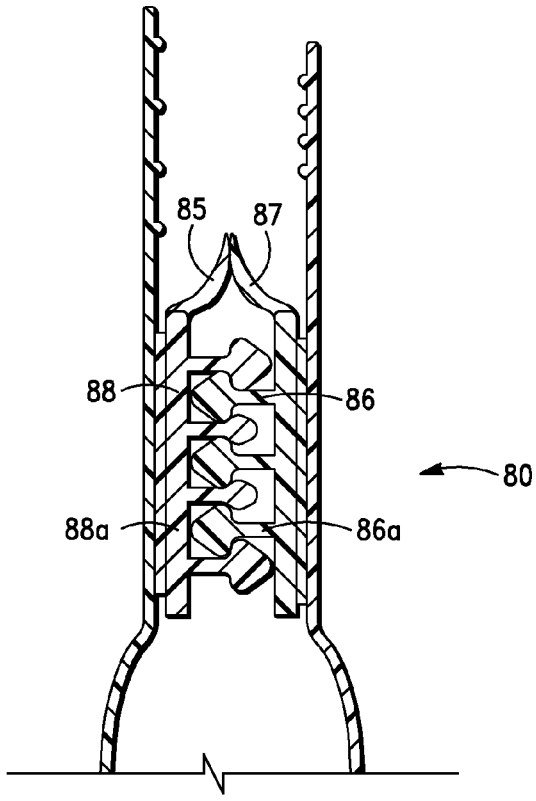

FIGS. 8A and 8B illustrate occlusion of another embodiment of the closure device. In accordance with the invention, male fastening strip 80 and female fastening strip 81 have flexible male wing 87 and flexible female wing 85. In this embodiment, the flexible male wing 87 and flexible female wing 85 extend beyond the male interlocking member 86 and the female interlocking member 88 in the non-occluded position shown in FIG. 8A. FIG. 8B shows the fully occluded closure where flexible male wing 87 and flexible female wing 85 interfere with one another and full occlusion of the closure requires greater force to engage the male interlocking member 86 and the female interlocking member 88 adjacent to the flexible wings 87 and 85 than to engage the male interlocking member 86*a* and the female interlocking member 88*a* that are remote from flexible wings 87 and 85.

Closure devices of the present invention suitably are substantially leakproof. For example, surfaces of the interlockable male and female closure elements preferably form a contiguous or snug fit with each other along the entire length of the closure device. In the suitable embodiments the interacting male and female wings are compressed as this significantly minimizes the possibility of leakage through the closure device.

Although several interlocking fastening strip embodiments have been specifically described and illustrated herein, it will be readily appreciated by those skilled in the art that other kinds, types, or forms of fastening strips can alternatively be used without departing from the scope or spirit of the present invention. The disclosed embodiments of the present invention are not to be construed as limiting. The art is replete with interlocking closure devices, zippers, and reclosable fasteners of different structures and configurations adaptable to thermoplastic bags. Examples of this art are seen in U.S. Pat. Nos. 4,363,345, 4,561,109, and 4,528,224. Prior art zipper structures can readily be modified in accordance with the present invention to form a zipper having the desired audible clicking and/or vibratory and bumpy feel which is tactile and perceptible to the touch.

In a further embodiment, one or both of the closure elements 30, 31 may include one or more textured portions, such as a bump or crosswise groove in one or more of the interlocking members 36, 36*a*, 38, 38*a* in order to provide a tactile sensation, such as a series of clicks, as a user draws the fingers along the closure mechanism to seal the closure elements across the opening. In another embodiment, all of the interlocking members 36, 36*a*, 38, 38*a* include textured portions along the length of the profile to provide tactile and/or audible sensations when closing the closure device 21. Further, in some embodiments, a sealing material such as a polyolefin material or a caulking composition such as silicone grease may be disposed on or in the closure profiles or closure elements 30, 31 to fill in any gaps or spaces therein when occluded. The ends of the closure profiles or closure elements 30, 31 may also be welded or sealed by ultrasonic vibrations as is known in the art. Illustrative interlocking profiles, closure elements, sealing materials, tactile or audible closure elements, and/or end seals useful in the present invention include those disclosed in, for example, Pawloski U.S. Pat. No. 4,927,474, Dais et al. U.S. Pat. Nos. 5,070,584, 5,478,228, and 6,021,557, Tomic et al. U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Pawloski et al. U.S. Pat. No. 7,137,736, Anderson U.S. Patent Application Publication No. 2004/0091179, Pawloski U.S. Patent Application Publication No. 2004/0234172, Tilman et al. U.S. Patent Application Publication No. 2006/0048483, and Anzini et al. U.S. Patent Application Publication Nos. 2006/0093242 and 2006/0111226, which are hereby incorporated in their entirety herein. It is further appreciated that the closure profiles or closure elements disclosed herein may be operated by hand, or a slider (not shown) may be used to assist in occluding and de-occluding the closure profiles and closure elements.

In order to develop differential opening and closing forces, one of the closure elements may be secured continuously to the respective sidewall along the entire profile of the base member, and the other closure element may be secured partially to the respective sidewall along only a portion of the profile. For example, in one embodiment, the closure element 30 is connected with the sidewall 22 continuously between the interlocking member 36 and the interlocking member 36*a*. The closure element 31 is connected with the other sidewall 22 continuously between the interlocking member 38 and an interior side of the wing 39, and an interior end of the closure element 31 is unconnected with the other sidewall 22 between the interior end of the interlocking member 38*a* and the interior side of the wing 39*a*. In this manner, differential opening and closing forces may be developed because the interior end and interlocking profile of the base 32 of at least the closure element 31 is allowed to hinge away from the sidewall 22, thereby minimizing an opening force caused by the contents pushing outwardly against the sidewalls 22.

When the fastening strips are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. For example, the bag may be made from a mixture of high pressure, low-density polyethylene and linear, low-density polyethylene.

In one embodiment, the sidewalls 22 and/or the closure elements 30, 31 are formed from thermoplastic resins by known extrusion methods. For example, the sidewalls 22 may be independently extruded of thermoplastic material as a single continuous or multi-ply web, and the closure elements 30, 31 may be extruded of the same or different thermoplastic material(s) separately as continuous lengths or strands. Illustrative thermoplastic materials include polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Further, inner surfaces of the sidewalls 22 or a portion or area thereof may, for example, be composed of a polyolefin plastomer such as an AFFINITY™ resin manufactured by Dow Plastics. Such portions or areas include, for example, the area of one or both of the sidewalls 22 proximate and parallel to the closure elements 30, 31 to provide an additional cohesive seal between the sidewalls when the bag 20 is evacuated of fluid. One or more of the sidewalls 22 in other embodiments may also be formed of air-impermeable film. An example of an air-impermeable film includes a film having one or more barrier layers, such as an ethylene-vinyl alcohol copolymer (EVOH) ply or a nylon ply, disposed between or on one or more of the plies of the sidewalls 22. The barrier layer may be, for example, adhesively secured between the PP and/or LDPE plies to provide a multilayer film. Other additives such as colorants, slip agents, and antioxidants, including for example talc, oleamide or hydroxyl hydrocinnamate may also be added as desired. In another embodiment, the closure elements 30, 31 may be extruded primarily of molten PE with various amounts of slip component, colorant, and talc additives in a separate process. The fully formed closure elements 30, 31 may be attached to the pouch body using a strip of molten thermoplastic weld material, or by an adhesive known by those skilled in the art, for example. Other thermoplastic resins and air-impermeable films useful in the present invention include those disclosed in, for example, Tilman et al. U.S. Patent application publication No 2006/0048483.

The fastening strips may be manufactured by extrusion through a die or other known methods and may be formed from any suitable thermoplastic material including, for example, polyethylene, polypropylene, nylon, or the like, or from a combination thereof. Thus, resins or mixtures of resins such as high-density polyethylene, medium-density polyethylene, and low-density polyethylene may be employed to prepare the interlocking fastening strips. For example, the closure device may be manufactured as individual fastening strips for later attachment to the bag or may be manufactured integrally with the bag. In addition, the fastening strips may be manufactured with or without flange portions on one or both of the fastening strips depending upon the intended use of the fastening strips or expected additional manufacturing operations. The resealable pouch described herein can be made by various techniques known to those skilled in the art including those described in, for example, Geiger, et al., U.S. Pat. No. 4,755,248. Other useful techniques to make a resealable pouch include those described in, for example, Zieke et al., U.S. Pat. No. 4,741,789. Additional techniques to make a resealable pouch include those described in, for example, Porchia et al., U.S. Pat. No. 5,012,561. Additional examples of making a resealable pouch as described herein include, for example, a cast post applied process, a cast integral process, and/or a blown process.

Generally, the fastening strips can be manufactured in a variety of forms to suit the intended use. The fastening strips may be integrally formed on the opposing sidewalls of the container or bag, or connected to the container by the use of any of several known methods. For example, a thermoelectric device may be applied to a film in contact with the flange portion of the fastening strips or the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding may be done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

The means for providing the male and female fastening strips preferably comprises an extruder (not shown) and a die means (not shown) to shape the profiles of the male and female closure elements or profiles of the fastening strips as is commonly known in the art. The means for providing the male and female fastening strips may also comprise a means for advancing the fastening strips.

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. On the contrary, it is intended to cover all alternatives, modifications and equivalents as may be included within the spirit and scope of the invention as defined by the appended claims.

What is claimed is:

1. A closure device for a reclosable plastic bag comprising first and second interlocking fastening strips arranged to be interlocked over a predetermined length, wherein the first fastening strip including a first interlocking member and a third interlocking member and further including a first flexible wing adjacent the first interlocking member and extending from the first fastening strip beyond the height of the first interlocking member and a third wing adjacent the third interlocking member and extending below the height of the third interlocking member; the second fastening strip including a second interlocking member for mating with the first interlocking member and a fourth interlocking member for mating with the third interlocking member, the second fastening strip further including a second flexible wing adjacent the second interlocking member and extending from the second fastening strip beyond the height of the second interlocking member and a fourth wing adjacent the fourth interlocking member and extending below the height of the fourth interlocking member; whereby the first wing engages with the second wing when the first and second fastening strips interlock, the third interlocking member interlocks with the fourth interlocking member before the first interlocking member interlocks with the second interlocking member, and the third wing does not engage with the fourth wing when the first and second fastening strips interlock.

2. The invention as in claim 1, wherein the third wing aligns opposite to the fourth wing and does not touch the forth wing when the first and second fastening strips interlock.

3. The invention as in claim 1, wherein the first and second wings are located on the outermost portions of the first and second fastening strips.

4. The invention as in claim 3, wherein first and second wings are located on the innermost side of the closure device located nearest to the closed bottom end portion of the bag.

5. The invention as in claim 1, wherein the first fastening strip contains a notch between the first interlocking member and the first wing.

6. A resealable closure mechanism having an elongate substantially constant profile extending between a first end and a second end, the profile comprising:

a first closure element having a first interlocking member, a third interlocking member, and a first wing member on the outermost portion of the first closure element adjacent to the first interlocking member, each protruding from a first base member; and a second closure element having a second interlocking member, a fourth interlocking member and a second wing member on the outermost portion of the first closure element adjacent to the second interlocking member, each protruding from a second base member;

wherein the first interlocking member is resealably interlocked with the second interlocking member and the third interlocking member is resealably interlocked with the fourth interlocking member; wherein the first and second wings are engaged and resealably deformed when the closure mechanism is closed and wherein the engagement of the first and second wings cause the first closure element and the second closure element to pivot so that the third interlocking member engages the forth interlocking member before the first interlocking member engages the third interlocking member.

7. The invention as in claim 6, wherein the first closure element has a third wing adjacent the third interlocking member and extending below the height of the third interlocking member, the second closure element has a fourth wing adjacent the fourth interlocking member and extending below the height of the fourth interlocking member, and the third wing does not engage with the fourth wing when the first and second fastening strips interlock.

8. The invention as in claim 6, wherein the first wing member extends from the first closure element beyond the height of the first interlocking member and the second wing member extends from the second closure element beyond the height of the second interlocking member.

9. The invention as in claim 6, wherein the first wing member extends from the first closure element up to or beyond the height of the first interlocking member and the first closure element includes a third wing member at the opposite end of the closure element from the first wing where the first wing member has greater height than the third wing member.

10. The closure mechanism of claim 6, wherein each of the first and third interlocking members comprises a pair of arms forming a channel-shaped female interlocking member, and wherein each of the second and fourth interlocking members comprises an arrow-shaped male interlocking member.

11. The closure mechanism of claim 6, wherein the first closure element has a first sealing member protruding from the first base member and disposed between the first interlocking member and the third interlocking member; and the second closure element has a second sealing member protruding from the second base member and disposed between the second interlocking member and the fourth interlocking member, and, wherein the second sealing member forms a generally V-shaped tapered channel; wherein the first sealing member is wedged into the generally V-shaped tapered channel of the second sealing member, whereby an airtight seal is formed.

12. A plastic bag including side walls joined at seams to form a compartment sealable by means of the closure device, wherein the side walls extend above the closure device to form mouth portions; wherein the closure device comprises first and second interlocking fastening strips arranged to be interlocked over a predetermined length, wherein the first fastening strip including a first interlocking member and a third interlocking member and further including a first flexible wing adjacent the first interlocking member and extending from the first fastening strip beyond the height of the first interlocking member; the second fastening strip including a second interlocking member for mating with the first interlocking member and a fourth interlocking member for mating with the third interlocking member, the second fastening strip further including a second flexible wing adjacent the second interlocking member and extending from the second fastening strip beyond the height of the second interlocking member; wherein the first wing engages with the second wing when the first and second fastening strips interlock and wherein the engagement of the first and second wings cause the first closure element and the second closure element to pivot so that the third interlocking member engages the forth interlocking member before the first interlocking member engages the third interlocking member.

13. The invention as in claim 12, wherein first and second wings are located on the innermost side of the closure device located nearest to the closed bottom end portion of the bag.

14. The invention as in claim 12, wherein the first fastening strip includes a third wing adjacent the third interlocking member and extending below the height of the third interlocking member and the second fastening strip includes a fourth wing adjacent the fourth interlocking member and extending below the height of the fourth interlocking member, whereby the third wing does not touch with the fourth wing when the first and second fastening strips interlock.

15. The invention as in claim 12, wherein the first fastening strip includes a third rigid wing adjacent the third interlocking member and the second fastening strip includes a fourth rigid wing adjacent the fourth interlocking member, whereby the third wing aligns next to the fourth wing when the first and second fastening strips interlock.

16. The invention as in claim 12, wherein the first fastening strip contains a notch between the first interlocking member and the first wing.

17. The closure mechanism of claim 12, wherein each of the first and third interlocking members comprises a pair of arms forming a channel-shaped female interlocking member, and wherein each of the second and fourth interlocking members comprises an arrow-shaped male interlocking member.

18. The closure mechanism of claim 12, wherein the first closure element has a first sealing member protruding from the first base member and disposed between the first interlocking member and the third interlocking member; and the second closure element has a second sealing member protruding from the second base member and disposed between the second interlocking member and the fourth interlocking member, and, wherein the second sealing member forms a generally V-shaped tapered channel; wherein the first sealing member is wedged into the generally V-shaped tapered channel of the second sealing member, whereby an airtight seal is formed.

* * * * *